United States Patent [19]

Kondo

[11] Patent Number: 4,588,112

[45] Date of Patent: May 13, 1986

[54] NOZZLE FOR CONTINUOUS CASTING

[75] Inventor: Masanao Kondo, Gifu, Japan

[73] Assignee: Akechi Ceramics Kabushiki Kaisha, Ena, Japan

[21] Appl. No.: 577,382

[22] Filed: Feb. 6, 1984

[51] Int. Cl.[4] ..... B22D 3/00

[52] U.S. Cl. ..... 222/603; 164/415; 164/437; 164/475

[58] Field of Search ..... 222/591, 603; 164/415, 164/437, 475

[56] References Cited

U.S. PATENT DOCUMENTS

| | | | |
|---|---|---|---|
| 3,651,998 | 3/1972 | Reches | 222/603 |
| 3,771,982 | 11/1973 | Dobo | 164/475 |
| 3,908,735 | 9/1975 | DiCandia | 164/475 |
| 4,137,961 | 2/1979 | Mola | 164/437 |
| 4,203,538 | 5/1980 | Luhrsen | 164/475 |
| 4,421,257 | 12/1983 | Throwes | 222/603 |
| 4,487,251 | 12/1984 | Cahoon et al. | 164/437 |

*Primary Examiner*—Albert J. Makay
*Assistant Examiner*—Steven E. Warner
*Attorney, Agent, or Firm*—Staas & Halsey

[57] ABSTRACT

A nozzle for continuous casting which is capable of uniformly supplying a required amount of gas to the inner wall surface thereof by providing a plurality of communication holes inside the nozzle body between the inner surface thereof and a gas pressure balance chamber disposed inside the nozzle body so as to communicate the chamber with the inner surface, the communication hole having a square measure corresponding to that of a circular hole having a diameter of 1.0 mm or less, and preferably between 0.03 and 0.5 mm. The nozzle body is comprised of a material having 20% or less porosity and containing 50% or more open pores, each having a diameter of 5 μm or less.

2 Claims, 4 Drawing Figures

NOZZLE FOR CONTINUOUS CASTING

BACKGROUND OF THE INVENTION

1. Field of the Invention

The present invention relates to a nozzle for continuous casting, and more particularly to a nozzle which is capable of uniformly supplying a required amount of gas to the inner wall surface thereof by providing a plurality of communication holes inside the nozzle body between the inner surface thereof and a gas pressure balance chamber disposed inside the nozzle body so as to communicate the chamber with the inner surface, the communication hole having a square measure corresponding to that of a circular hole having a diameter of 1.0 mm or less.

2. Description of the Prior Art

A gas blow-in type nozzle for continuous casting heretofore has been known wherein an inert gas is blown in to an inner surface of the nozzle through the nozzle body so as to form a gas seal on the inner wall surface and prevent the nozzle from clogging. As shown in FIGS. 1 and 2, this kind of nozzle has a gap which is made by using such solid material as will disappear during the burning process for manufacturing a nozzle, for example, paper, polypropyrene, nylon, paraffin, etc. Namely the gap is made by providing said material in an appropriate place inside the nozzle body at the time of molding and thereafter burning it down. The gap or gas pressure balance chamber 2 is connected via a gas inlet hole 3 to an inert gas supply source disposed outside the nozzle body 1 while being communicated to the inner surface of the nozzle body via open pores existing therein, whereby the inert gas is made to blow into the space between the inner wall surface and the molten steel. The open pores which communicate the gas pressure balance chamber 2 with the inner surface of the nozzle are naturally formed during the nozzle manufacturing process so that the existence of the open pores in not always uniform and varies according to the manufacturing conditions. Therefore there has arisen a problem that the amount of gas supplied to the inner surface is not constant or uniform. Especially in the case where the open pores of less than 5 μm in diameter exist more than 50%, it is practically difficult to blow in the gas and impossible to form a perfect gas seal.

SUMMARY OF THE INVENTION

It is an object of the present invention to eliminate the foregoing disadvantages as seen in the conventional gas blow-in type nozzle for continuous casting and to provide a new and useful nozzle capable of uniformly supplying a required amount of gas to the inner wall surface of the nozzle and also capable of continuous casting without clogging the nozzle, by providing a plurality of communication holes in the nozzle body between the gas pressure balance chamber and the inner surface of the nozzle so as to communicate said chamber with said inner surface, each of said communication hole having a square measure corresponding to that of a circular hole having a diameter of 1.0 mm or less and preferably between 0.03 and 0.5 mm. The nozzle body is comprised of a material having 20% or less porosity and containing 50% or more open pores, each having a diameter of 5 μm or less.

DETAILED DESCRIPTION OF THE PREFERRED EMBODIMENTS

Figure 3:
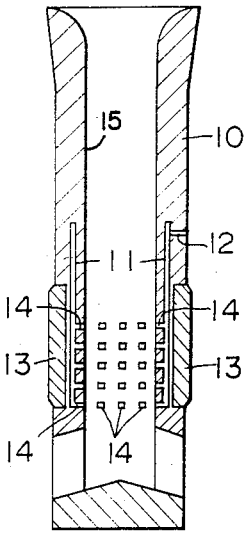
FIGS. 3 and 4 are vertical sectional views showing nozzles according to the present invention.
Figure 4:
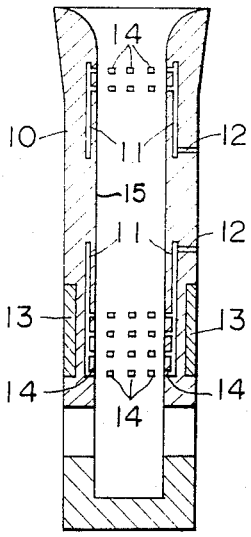

Referring to FIGS. 3 and 4, a nozzle body 10 has a slit-form gap or gas pressure balance chamber 11 which is disposed in an appropriate place inside the walls of the nozzle body 10. A gas inlet hole 12 is formed inside the nozzle body 10 so as to connect the gas pressure balance chamber 11 to an inert gas supply source disposed outside the nozzle. Numeral 13 indicates a slag line portion. A plurality of communication holes 14 are formed in the longitudinal and diametrical directions of the nozzle body 10 at appropriate intervals so as to communicate the gas pressure balance chamber to the inner wall surface of the central tubular passageway 15 of the nozzle body 10. The communication hole is 1.0 mm or less in diameter, or preferably the best-suited diameter is 0.03 to 0.5 mm considering the penetration of the molten steel to the communication hole 14 when the inert gas is not blown in. The best-suited sectional shape of the communication hole is a circular one for the purpose of preventing the occurrence of the structural defects of the nozzle, but of course it is to be noted that the sectional shape of the communication hole 14 must not be limited thereto and may be in any shape whatever as long as the square measure of the hole corresponds to that of a circular hole within the scope of the aforementioned size. The present invention is most effective when the nozzle body is mainly made of generally known natural graphite and various kinds of alumina, for example, sintered alumina, α-alumina, β-alumina, high-alumina materials (mullite, sillimanite, etc.) and chemically composed of 10% to 40% carbon, 40% to 80% alumina and 20% or less silica, etc., with the use of synthetic resin bond as a bonding agent.

The present invention will be explained hereinbelow with reference to the following examples.

TABLE 1

Figure 1:
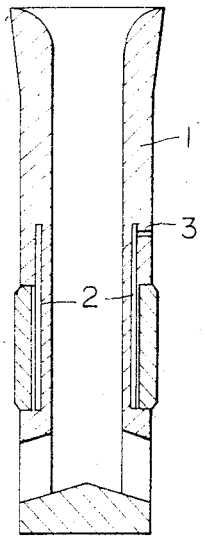
FIG.1 PRIOR ART
FIGS. 1 and 2 are vertical sectional views showing conventional nozzles.

| | Conventional Nozzle | Present Nozzle |
|---|---|---|
| Average Diameter of Open Pores inside Nozzle Body | 8.5 μm | 1.0 μm |
| Diameter of Communication Hole | no hole | 200 μm |
| Shape of Nozzle | FIG. 1 | FIG. 3 |
| Amount of Supplied Gas (l/min. 1 kg pressure) | 5.0 | 10.3 |

TABLE 2

Figure 2:
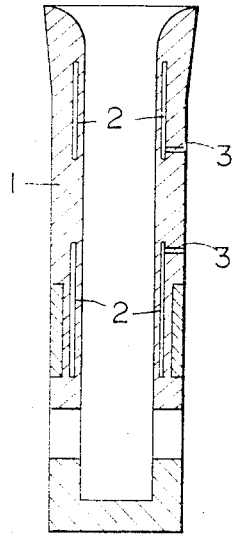
FIG.2 PRIOR ART

| | Conventional Nozzle | Present Nozzle |
|---|---|---|
| Average Diameter of Open Pores inside Nozzle Body | 3.0 μm | 3.0 μm |
| Diameter of Communication Hole | no hole | 100 μm |
| Shape of Nozzle | FIG. 2 | FIG. 4 |

TABLE 2-continued

| | Conventional Nozzle | Present Nozzle |
|---|---|---|
| Amount of Supplied Gas (l/min. 1 kg pressure) | 3.2 | 9.6 |

EXAMPLE 1

When simultaneously using the two immersion nozzles shown in Table 1 for pouring Al-killed steel of Sol-Al 0.070% with ladle having a capacity of 250 tons, the present nozzle was capable of perfectly pouring eight ladles without any adhesion of $Al_2O_3$ while the conventional nozzle was adhered with $Al_2O_3$ when it poured five ladles and incapable of further casting. Thus the remarkable effects of the present nozzle have been confirmed.

EXAMPLE 2

When simultaneously using the two immersion nozzles shown in Table 2 for pouring Al-killed steel of Sol-Al 0.05% with ladle having a capacity of 300 tons, the present nozzle was capable of perfectly pouring seven ladles without any adhesion of $Al_2O_3$ while the conventional nozzle was adhered with $Al_2O_3$ when it poured four ladles and incapable of further casting. Thus the remarkable effects of the present nozzle have been confirmed.

As seen from the above, the immersion nozzle according to the present invention was capable of continuous casting without clogging up, as compared with the conventional one.

Numerous alterations and modifications of the structure herein disclosed will suggest themselves to those skilled in the art. It is to be understood, however, that the present disclosure relates to he preferred embodiments of the invention which is for purposes of illustration only and is not to be construed as a limitation of the invention. All such modifications which do not depart from the spirit of the invention are intended to be included within the scope of the appended claims.

What is claimed is:

1. A nozzle for continuous casting of molten material, comprising:

a nozzle body having walls defining a central passageway therein for receiving said molten material;

a gas pressure balance chamber formed annularly inside said walls;

a gas inlet formed in said walls extending from said chamber to the outside of said nozzle body for connection to a supply of gas; and a plurality of communication holes for said gas extending from said chamber to said central passageway, each of said communication holes having a diameter of 0.03 to 0.5 mm.

2. A nozzle for continuous casting as claimed in claim 1, wherein said nozzle body is comprised of a material having 20% or less porosity and contains 50% or more open pores, each having a diameter of 5 um or less.

* * * * *

UNITED STATES PATENT AND TRADEMARK OFFICE

CERTIFICATE OF CORRECTION

PATENT NO. : 4,588,112

DATED : 5/13/86

INVENTOR(S) : KONDO

It is certified that error appears in the above-identified patent and that said Letters Patent is hereby corrected as shown below:

[73] Assignee
"ENA" should be --Gifu--.

[56] References Cited
"Reches" should be --Rocher--;
"Throwes" should be --Thrower--.

Col. 1
Line 60, "hole" should be --holes--.

Col. 4
Line 34, "5 um" should be --5μm--.

Signed and Sealed this

Fourteenth Day of October, 1986

[SEAL]

*Attest:*

DONALD J. QUIGG

*Attesting Officer*

*Commissioner of Patents and Trademarks*